US005346014A

United States Patent [19]

Ross

[11] Patent Number: 5,346,014

[45] Date of Patent: Sep. 13, 1994

[54] HEAT ACTIVATED BALLISTIC BLOCKER

[75] Inventor: Richard J. Ross, Houston, Tex.

[73] Assignee: Baker Hughes Incorporated, Houston, Tex.

[21] Appl. No.: 31,651

[22] Filed: Mar. 15, 1993

[51] Int. Cl.[5] ..... E21B 43/116

[52] U.S. Cl. ..... 166/297; 102/201; 166/302; 166/55; 175/4.54

[58] Field of Search ..... 102/202.1, 222, 201; 89/1.15; 175/4.54, 4.56; 166/297, 302, 55

[56] References Cited

U.S. PATENT DOCUMENTS

| | | | |
|---|---|---|---|
| Re. 25,846 | 8/1965 | Campbell . | |
| 2,637,402 | 5/1953 | Baker et al. . | |
| 2,640,547 | 6/1953 | Baker et al. . | |
| 2,655,993 | 10/1953 | Spencer . | |
| 2,692,023 | 10/1954 | Conrad . | |
| 2,695,064 | 11/1954 | Ragan et al. . | |
| 2,996,591 | 8/1961 | Thomas . | |
| 4,084,147 | 4/1978 | Mlyniec et al. | 337/407 |
| 4,085,397 | 4/1978 | Yagher, Jr. | 337/407 |
| 4,266,613 | 5/1981 | Boop | 166/299 |
| 4,284,235 | 8/1981 | Diermayer et al. | 236/1 G |
| 4,306,628 | 12/1981 | Adams, Jr. et al. | 175/4.56 |
| 4,619,320 | 10/1986 | Adnyana et al. | 166/65.1 |
| 5,052,300 | 10/1991 | Josse | 102/201 |
| 5,070,788 | 12/1991 | Carisella et al. | 102/222 |
| 5,159,145 | 10/1992 | Carisella et al. | 89/1.15 |
| 5,159,146 | 10/1992 | Carisella et al. | 89/1.15 |
| 5,165,489 | 11/1992 | Langston | 175/4.54 |

OTHER PUBLICATIONS

SPE Paper No. 22556, Carisella et al, Three New Systems That Prevent Firing of Perforating Guns and String Shots On or Near the Surface.

*Primary Examiner*—William P. Neuder
*Attorney, Agent, or Firm*—Melvin A. Hunn; Mark W. Handley

[57] ABSTRACT

A method and an apparatus for use in a wellbore are provided to prevent an igniter from igniting a pyrotechnic device within a downhole well tool until after the downhole well tool is positioned downhole within the wellbore. A blocking member is movable between two positions for selectively obstructing an ignition pathway between the igniter and pyrotechnic device. An actuator is provided which, when heated to an activation temperature by downhole well temperatures, moves the blocking member from a position obstructing the ignition pathway to a position for allowing the igniter to ignite the pyrotechnic device.

32 Claims, 4 Drawing Sheets

HEAT ACTIVATED BALLISTIC BLOCKER

BACKGROUND OF THE INVENTION

1. Field of the Invention

This invention relates in general to an apparatus and method for use to provide a downhole well tool which is prevented from actuating until the downhole well tool is positioned downhole within a wellbore, and in particular to a downhole wellbore tool including a wireline pressure setting assembly having a heat activated ballistic blocker which prevents actuation of the wireline pressure setting assembly until after it is lowered downhole within a wellbore.

2. Background Art

Explosives and other pyrotechnic materials have been used in prior art downhole well tools to provide forces for performing work downhole within wellbores. A few examples of such downhole tools for providing explosive forces include perforating guns, which provide explosive forces for providing fluid flowpaths, squibs, which may be used for releasing mechanically biased members, tubing cutters, which may be used for cutting wellbore tubular members, and back-off shots, which may be utilized for providing shock to loosen threaded pipe joints within wellbores. An example of a downhole tool which is used to apply non-explosive forces is a wireline pressure setting assembly, which may be used for setting bridge plugs and packers within wellbores.

Another example of a prior art downhole well tool which incorporates use of explosives is a cable conveyed bridge plug for setting within a cased wellbore such as that shown in U.S. Pat. No. 2,637,402, entitled "Pressure Operated Well Apparatus," invented by R. C. Baker et al., and issued to Baker Oil Tools, Inc. on May 5, 1953. A similar cable conveyed downhole well tool is disclosed in U.S. Pat. No. 2,695,064, entitled "Well Packer Apparatus," invented by T. M. Ragan et al., and issued to Baker Oil Tools, Inc. on Nov. 23, 1954. These patents disclose cable conveyed downhole well tools for setting a bridge plug within a wellbore casing. These cable conveyed downhole well tools were actuated by the percussion of a firing pin causing a cartridge to explode and ignite a prior art power cartridge, or combustible charge.

An example of a prior art wireline conveyed well packer apparatus is disclosed in U.S. Pat. No. Re. 25,846, entitled "Well Packer Apparatus," invented by D. G. Campbell, and issued to Baker Oil Tools, Inc. on Apr. 31, 1965. The wireline conveyed well packer apparatus disclosed includes a power charge which is ignited to generate gas for setting the well packer apparatus within a wellbore. The power charge is ignited by passing an electric current down the wireline and exploding an igniter cartridge, which causes a flame to ignite the power charge.

An example of a prior art power charge for use in downhole well tools to generate a gas to provide a force for use to set packers and bridge plugs is a combustion charge disclosed in U.S. Pat. No. 2,640,547, entitled "Gas-Operated Well Apparatus," invented by R. C. Baker et al., and issued to Baker Oil Tools, Inc. on Jun. 2, 1953. The combustion charge is comprised of combustion materials which, when ignited within a downhole well tool disclosed in the patent, will take at least one second for a maximum pressure to be attained within the downhole well tool. This prior art combustion charge includes both a fuel and a self-contained oxygen source. The combustion charge is ignited to generate a gas having a pressure which provides a force for setting the gas-operated well apparatus. The combustion charge of the gas-operated well apparatus is ignited by exploding an igniter to start the combustion reaction for burning the combustion charge. The combustion charge, once ignited, burns in a self-sustained combustion reaction to generate the gas.

A prior art wireline pressure setting assembly is disclosed in U.S. Pat. No. 2,692,023, entitled "Pressure Operated Subsurface Well Apparatus," invented by M. B. Conrad, and issued to Baker Oil Tools, Inc. on Oct. 19, 1954. This wireline conveyed downhole well tool includes a power charge which is burned in a combustion reaction to generate a gas. The power charge is ignited by electrically exploding an igniter cartridge which then emits a flame to start the power charge burning. Combustion of the power charge generates the gas having a pressure which provides force for operation of the wireline setting tool to set a downhole tool such as a packer or bridge plug within the wellbore.

Each of the above-referenced patents, U.S. Pat. No. 2,640,547, Re. 25,846, 2,695,064, 2,637,402, and 2,692,023, are hereby incorporated by reference as if fully set forth and disclosed herein.

The above prior art downhole well tools for converting the chemical components of a power charge into a mechanical force exerted over a distance typically require a separate igniter cartridge for igniting the power charge. Additionally, other pyrotechnic wellbore devices utilize an igniter, as well as incorporate the igniter and the pyrotechnic device into a singular package. Typically, explosive components are used for prior art igniter materials, such as, for example, gunpowder or lead azide. These types of igniter materials are easily ignited and represent hazards both to operators utilizing these materials in downhole well tools, and to successful completion of wellsite operations. Some of these types of primary ignition or igniter materials are susceptible to ignition from applications of small amounts of electric current, or even discharge of static electricity.

Wellsite operations utilizing prior art downhole well tools which present hazards if operated outside of the wellbore would be safer if prevented from operating until lowered downhole with a wellbore. Such a safety feature would enhance operator safety, as well as promote successful wellsite operations.

SUMMARY OF THE INVENTION

It is one objective of the present invention to provide a method and apparatus for use in a wellbore to prevent an igniter from igniting a pyrotechnic device within a downhole well tool until after the downhole well tool is positioned downhole within the wellbore.

It is another objective of the present invention to provide a method and apparatus for use in a wellbore to automatically provide an ignition pathway between an igniter and a pyrotechnic device within a downhole well tool after the downhole well tool is lowered downhole within the wellbore.

It is yet another objective of the present invention to provide a method and apparatus for use in a wellbore to prevent an igniter from igniting a propellant within a wellbore pressure setting assembly until after the wellbore pressure setting assembly is lowered downhole within the wellbore.

It is further another objective of the present invention to provide a method and apparatus for use in a wellbore to automatically provide an ignition pathway between an igniter and a power charge containing a propellant within a wireline pressure setting assembly once the wireline pressure setting assembly is lowered downhole within the wellbore.

These objectives are achieved as is now described. A method and an apparatus for use in a wellbore are provided to prevent an igniter from igniting a pyrotechnic device within a downhole well tool until after the downhole well tool is positioned downhole within the wellbore. A blocking member is movable between two positions for selectively obstructing an ignition pathway between the igniter and pyrotechnic device. An actuator is provided which, when heated to an activation temperature by downhole well temperatures, rotates the blocking member from a position obstructing the ignition pathway to a position for allowing the igniter to ignite the pyrotechnic device.

In the preferred embodiment of the present invention, a method and apparatus for use in a wellbore are disclosed for automatically providing an ignition pathway for passing thermal energy from an igniter to a power charge within a wireline pressure setting assembly once the wireline pressure setting assembly is lowered downhole within a wellbore. A valve plug having a passageway extending laterally therethrough is provided for selectably obstructing a bore extending between a primary and a secondary igniter within a wireline pressure setting assembly. A torsion member retains the valve plug in a blocking position obstructing the bore extending between the primary and secondary igniter until the torsion member is heated to an actuation temperature by exposure to downhole well temperatures. Once heated to the activation temperature, the torsion spring rotates the valve plug to an ignition position, aligning the passageway extending laterally through the valve plug with the bore extending between the primary and secondary igniters to provide an ignition pathway therebetween.

Additional objects, features and advantages will be apparent in the written description which follows.

BRIEF DESCRIPTION OF THE DRAWING

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
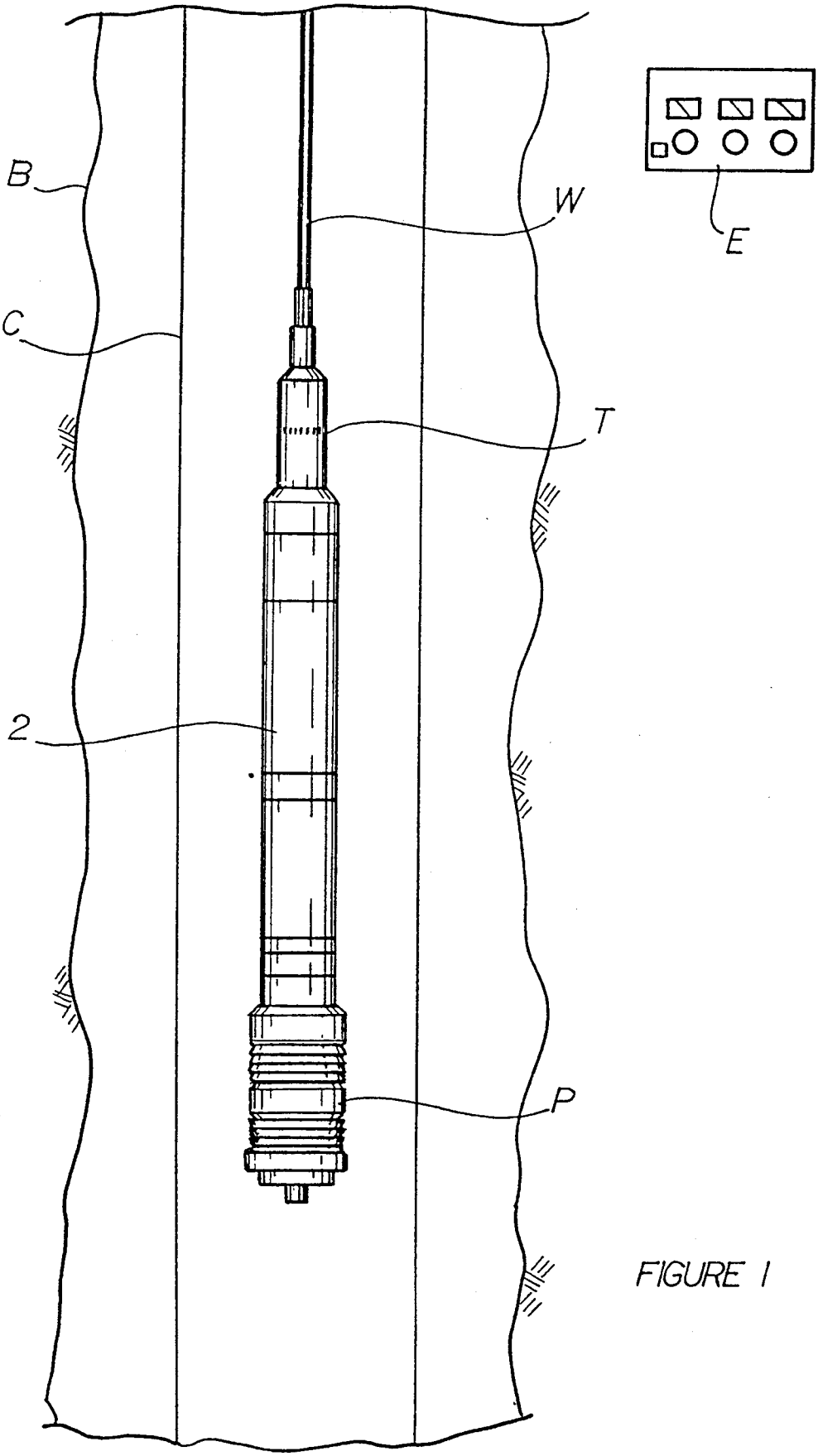
FIG. 1 is a partial longitudinal section view of a wellbore depicting a wireline tool string which includes the downhole well tool of the preferred embodiment of the present invention.

Referring to FIG. 1, a partial longitudinal section view depicts wellbore B having casing C within which wireline tool string T is secured to wireline W. Electrical power supply E is schematically shown for providing power to tool string T. Wireline tool string T includes downhole well tool 2 which, in the preferred embodiment of the present invention, is a wireline pressure setting assembly. Tool string T further includes a packer P which is releasably secured to downhole well tool 2 for positioning and setting within casing C.

Figure 2:
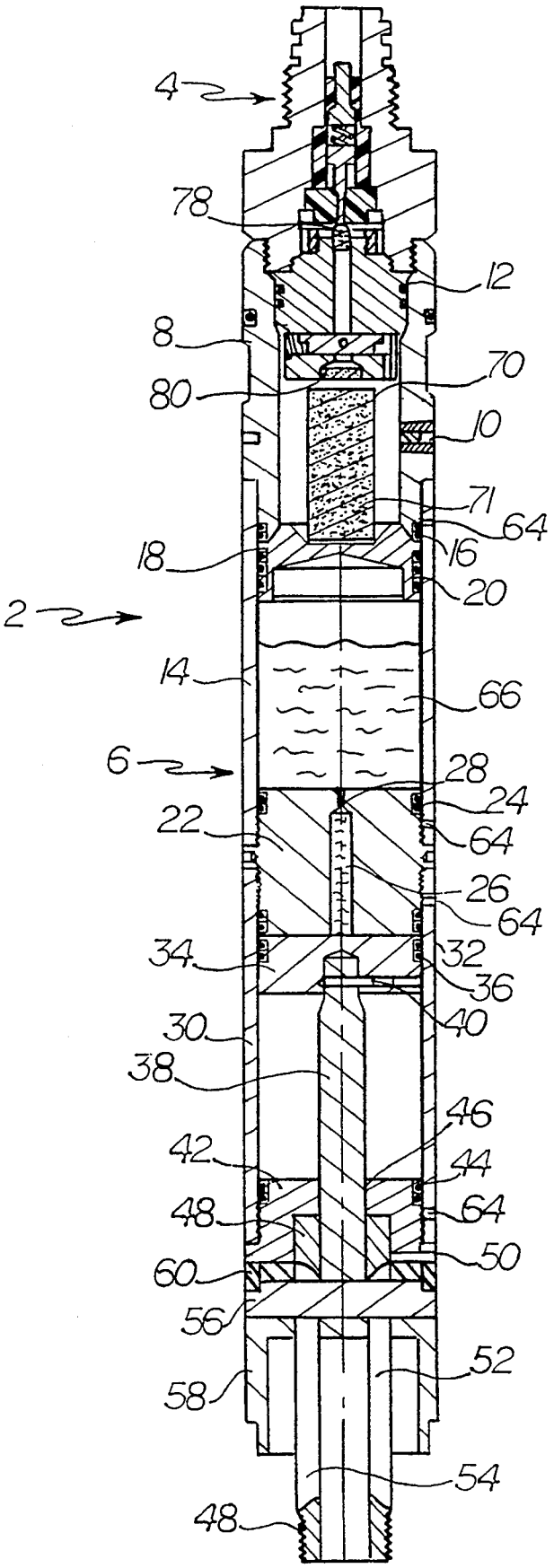
FIG. 2 is a longitudinal section view of the downhole well tool of the preferred embodiment of the present invention, which includes a wireline pressure setting assembly which is shown prior to running downhole within a wellbore and prior to actuation within the wellbore.

With reference to FIG. 2, a longitudinal section view shows downhole well tool 2 prior to being lowered downhole within a wellbore and prior to actuation. In the preferred embodiment of the present invention, downhole well tool 2 is, in general, a wellbore pressure setting assembly, and in particular, downhole well tool 2 is a wireline pressure setting assembly having an elongated tubular body, and including firing head 4 and pressure setting tool 6.

Pressure setting tool 6 includes pressure chamber 8. Pressure chamber 8 includes a manual bleeder valve 10 for bleeding pressure from within pressure chamber 8 after operation of downhole well tool 2. An upper end of pressure chamber 8 threadingly engages firing head 4 and fluid flow therebetween is prevented by seal 12.

Upper cylinder 14 is threadingly coupled to a lower end of pressure chamber 8, and seal 16 prevents fluid flow therebetween. Within upper cylinder 14 is floating piston 18, which is a pressure responsive member. Floating piston 18 is movable within upper cylinder 14 and, during operation of downhole well tool 2, is urged to move downward by gas pressure within pressure chamber 8. Seal 20 prevents fluid flow between an outer circumference of floating piston 18 and an interior diameter of upper cylinder 14.

Cylinder connector 22 is threadingly coupled to a lower end of upper cylinder 14. Seal 24 prevents fluid flow between an outer circumference of an upper end of cylinder connector 22 and an interior of the lower end of upper cylinder 14. Cylindrical connector 22 includes flow port 26 having orifice 28 which substantially measures three-sixteenths of an inch in diameter at an upper end of flow port 26.

Lower cylinder 30 has an upper end which is threadingly coupled to a lower portion of cylindrical connector 22. Seal 32 prevents fluid flow between an outer circumference of the lower end of cylindrical connector 22, and an interior of the upper end of lower cylinder 30.

Secondary piston 34 is disposed interiorly of and is movable within lower cylinder 30. Secondary piston 34 is a second pressure responsive member and is movable within lower cylinder 30. Seal 36 seals between an outer circumference of secondary piston 34 and an interior diameter of lower cylinder 30.

Piston rod 38 is secured to secondary piston 34 by lock pin 40, and is also movable within lower cylinder 30.

Cylinder head 42 is threadingly coupled to the lower end of lower cylinder 30. Seal 44 prevents fluid flow between the outer circumference of cylinder head 42 and the interior diameter of lower cylinder 30. Seal 46 prevents fluid flow between an interior surface of cylinder head 42 and an outer circumference of piston rod 38, which is movable with respect to cylinder head 42 and seal 46.

Mandrel 48 has an upper end which is threadingly secured within cylinder head 42. Set screw 50 prevents rotation of mandrel 48 within cylindrical head 42 after mandrel 48 is threadingly secured within cylindrical head 42. Mandrel 48 includes longitudinally extending slot 52, and longitudinally extending slot 54 which are two diametrically opposed longitudinally extending slots through an outer tubular wall of mandrel 48.

Cross link 56 inserts through longitudinally extending slot 52 and longitudinally extending slot 54, and is movable longitudinally within slots 52 and 54. Cross link 56 further inserts through piston rod 38 and sleeve 58 to couple sleeve 58 to piston rod 38. Cross link retaining ring 60 retains cross link 56 within sleeve 58 to maintain cross link 56 in engagement within sleeve 58 and piston rod 38. Lock screw 62 (not shown) secures cross link retaining ring 60 to sleeve 58.

Sleeve 58 is a driven member which is driven downward by piston rod 38 and cross link 56 when secondary piston 34 is urged into moving downward during operation of downhole well tool 2.

Pressure equalization ports 64 and manual bleeder valve 10 are provided for releasing fluid pressure from within pressure chamber 8, upper cylinder 14, and lower cylinder 30 after operation of downhole well tool 2. Pressure equalization ports 64 are provided at seal 16, seal 24, and seal 44. During disassembly of downhole well tool 2 after operation within wellbore B, thread pressure equalization ports 64 allow release of pressure from within downhole well tool 2 by passing over seal 16, seal 24, and seal 44, respectively, prior to the threaded connections of these seals being completely uncoupled. Thread pressure equalization ports 64 thus allow pressure to be released from the interior of downhole well tool 2 prior to fully uncoupling portions of downhole well tool 2.

Hydraulic fluid 66 is contained between floating piston 18 and secondary piston 34 to provide an intermediate fluidic medium for transferring force between floating piston 18 and secondary piston 34. As shown in FIG. 2, prior to actuating pressure setting tool 6, hydraulic fluid 66 is primarily disposed within upper cylinder 16.

During operation of pressure setting tool 6 to move sleeve 58 with respect to mandrel 48, a gas pressure generated within pressure chamber 8 urges floating piston 18 downward. Downward movement of floating piston 18 presses hydraulic fluid 66 through orifice 28 and flow port 26 to drive secondary piston 34 downward. Movement of secondary piston 34 downward within lower cylinder 30 causes piston rod 38, cross link 56, and sleeve 58 to move downward with respect to lower cylinder 30 and mandrel 48. Firing head 4, pressure chamber 8, upper cylinder 14, cylinder connector 22, lower cylinder 30, cylinder head 42, and mandrel 48 remain stationery as floating piston 18, hydraulic fluid 66, secondary piston 34, piston rod 38, cross link 56, sleeve 58, and cross link retaining ring 60 move within pressure setting tool 6.

Still referring to FIG. 2, power charge 70 is shown disposed within pressure chamber 8 prior to actuation for providing pressure to urge floating piston 18 downwards within upper cylinder 14. In the preferred embodiment of the present invention, chemical components within power charge 70 serve as a propellant which burn to generate a gas having a pressure which urges floating piston 18 downwards. Power charge 70 is self-contained since it is packaged within a singular container in the preferred embodiment of the present invention.

Figure 3:
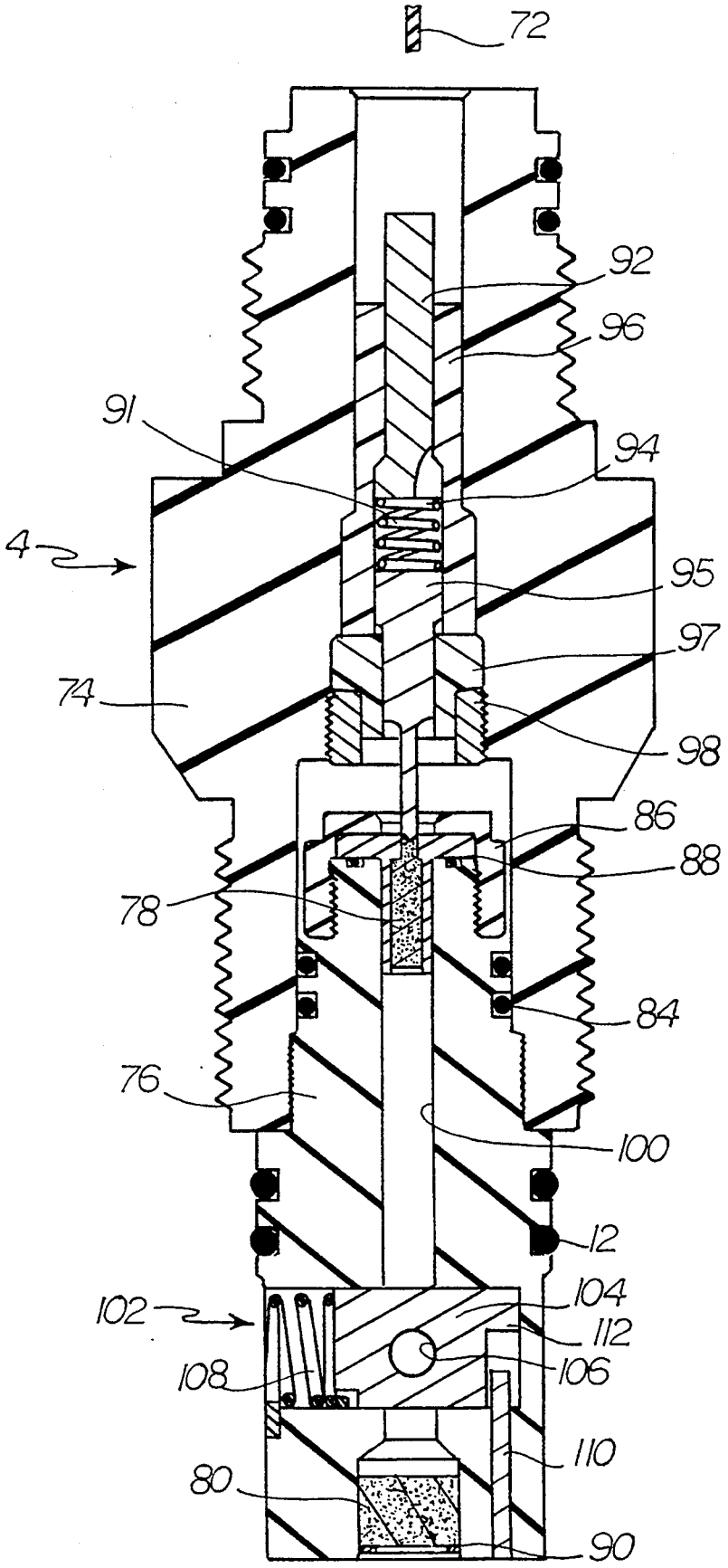
FIG. 3 is a longitudinal section view of a portion of a wireline pressure setting assembly of the preferred embodiment of the present invention, which depicts a firing head having a connector housing and an igniter housing, and which is shown prior to lowering to a downhole position within a wellbore.

Referring now to FIG. 3, a longitudinal section view of a portion of the wireline pressure setting assembly of the preferred embodiment of the present invention, downhole well tool 2, depicts firing head 4. Firing head 4 threadingly secures to the upper end of pressure chamber 8, and is sealed by seal 12 as discussed above. Firing head 4 is electrically connected to power supply E (not shown in FIG. 3) by, in part, power conductor 72. Firing head 4 includes connector housing 74, and igniter housing 76. Igniter housing 76 houses primary igniter 78, such as a BP3A primary igniter, and further houses secondary igniter 80. BP3A primary igniter 78, secondary igniter 80, and power charge 70, are manufactured by and available from Baker Oil Tools Inc., a division of Baker Hughes Inc., both of Houston, Tex. In the preferred embodiment of the present invention, primary igniter 78 and secondary igniter 80 include explosive materials for igniting power charge 70.

An upper end of connector housing 74 is threaded for connection to a wireline tool string (not shown in FIG. 3). A lower end of connector housing 74 threadingly engages an upper end of pressure chamber 8 (not shown in FIG. 3). Igniter housing 76 is threadingly coupled within the lower end of connector housing 74 by a left-hand threaded connection. Seal 12 sealingly engages between an outer circumference of igniter housing 76 and an interior diameter of pressure chamber 8 to prevent fluid flow therebetween. Seal 84 sealingly engages between an outer circumference of igniter housing 76 and an interior diameter of the lower end of connector housing 74 to prevent fluid flow therebetween.

Cartridge cap 86 retains primary igniter 78 within an upper end of igniter housing 76. Seal 88 sealingly engages between cartridge cap 88 and primary igniter 78. Secondary igniter 80 is held within igniter housing 76 by snap ring 90.

Electrical connector assembly 91 is utilized to electrically connect a wireline, or wireline tool string, to primary igniter 78. Electrical connector assembly 91 includes upper connector pin 92, connector spring 94, and lower connector pin 95. Electrical connector assembly 91 is insulated by insulator sleeve 96 and pin insulator 97 to prevent electrical continuity between connector housing 74 and electrical connector assembly 91. Insulator sleeve 96 and pin insulator 97 are made from suitable insulating materials, such as, for example, polytetrafluoroethylene, which is available from E. I. DuPont De Nemours and Company under the registered trademark TEFLON®. Connector lock ring 98 threadingly engages within connector housing 74 to hold insulator sleeve 96, pin insulator 97, and electrical connector assembly 91 in place within connector housing 74.

Connector spring 94 is a biasing member which, in the preferred embodiment of the present invention, pushes between both upper connector pin 92, and lower connector pin 95 to provide electrical continuity therebetween. Connector spring 94 also urges upper connector pin 92 upwards and lower connector pin 95 downward and into electrical contact with the upper end of primary igniter 78.

Still referring to FIG. 3, bore 100, extends longitudinally through igniter housing 76 for providing a portion of an ignition pathway extending between primary igniter 78 and secondary igniter 80. Heat activated ballistic blocker 102 is shown in FIG. 3 disposed within igniter housing 76 in a blocking position, obstructing bore 100.

Heat activated ballistic blocker 102 includes: valve plug 104 having passageway 106, torsion member 108, and rotation stop pin 110. Valve plug 104 is, in the preferred embodiment of the present invention, a steel cylindrical plug which inserted into a cylindrical bore extending laterally into igniter housing 76, across bore 100. In the preferred embodiment of the present invention, valve plug 104 does not provide a fluid tight seal across bore 100, but rather obstructs bore 100 to prevent sufficient thermal energy for igniting secondary igniter 80 from passing through bore 100.

Passageway 106 is a bore drilled laterally through valve plug 104 for selectably forming another portion of ignition pathway between primary igniter 78 and secondary igniter 80. Valve plug 104 further includes a rotation stop shoulder 112. Valve plug 104 is a blocking member which may be selectably rotated within igniter housing 76 for selectably obstructing bore 100 for blocking the ignition pathway between primary igniter 78 and secondary igniter 80, and for selectably aligning passageway 106 with bore 100 for providing an ignition pathway therethrough.

Heat activated ballistic blocker 102 further includes torsion member 108 which provides an actuator for selectably rotating to actuate rotating plug 104 between a blocking position, in which rotating plug 104 obstructs bore 100, and an ignition position, in which passageway 106 is aligned with bore 100 for providing an ignition pathway therethrough. The actuator for a ballistic blocker of the present invention, such as torsion member 108, should be chosen so that it will not actuate at the highest temperature at which it will be exposed to at the ground level surface of the wellbore, prior to being lowered to a position downhole within the wellbore.

In the preferred embodiment of the present invention, torsion member 108 is a thermally responsive member made from a shape memory metal alloy, which will undergo a thermoelastic martensitic reversion at a predeterminable temperature, such as, for example, a nickel-titanium shape memory metal alloy, which will undergo a thermoelastic martensitic reversion when heated to substantially 120° Fahrenheit. Torsion member 108 is coiled, or wound, in the shape of a spring from wire formed of a nickel-titanium alloy commonly known as "shape-memory alloy," or "memory metal alloy."

Shape memory metal alloys are characterized by their ability to undergo a thermoelastic martensitic transformation, a crystalline phase change that occurs within a transition temperature range. These alloys may be worked, in an austenitic state wherein martensitic structure is not present, to one shape or configuration, cooled to below the transformation temperature range to produce the martensitic structure at low temperature, and worked into another shape or configuration. Upon exposure of the memory metal article to a temperature above the transformation temperature range, the martensitic structure dissipates and the article returns to the shape or configuration given it in the austenitic state. During this transformation, the return of the article to the shape given it in the austenitic state occurs violently, in a high-stress transformation, which permits the article to perform work during the transformation. In the preferred embodiment of the present invention, the shape memory metal alloy is TINEL alloy K, purchased in wire form from Raychem Corporation, and has a minimum transformation temperature of substantially not less than 120° Fahrenheit.

Accordingly, torsion member 108 can be formed in the austenitic state to have a selected austenitic-state condition having a first shape. Torsion member 108 then may be cooled below the transformation temperature range to yield an actuator having a second shape when transformed to a martensitic structure at room temperature. Torsion member 108 will then have a first shape when heated to the austenitic state, and a second shape when cooled to the martensitic state. Therefore, the shape of torsion member 108 will vary depending on its crystal structure, i.e., whether torsion member 108 is in a martensitic state, or is transformed to an austenitic state by exposure to elevated temperatures above the transformation temperature range.

Preferably, torsion member 108 is formed of a "two-way" memory metal that transforms back and forth between the austenitic and martensitic crystal structures repeatedly, dependent on the ambient temperature conditions to which it is exposed. Thus, torsion member 108 will have two different shapes: a first shape at ambient temperatures above the transformation temperature range, and a second shape at ambient temperatures below the transformation temperature range.

This transformation temperature range for the material selected determines the activation temperature for heat activated ballistic blocker 102. Thus, the activation temperature is selectable by choosing different materials to form torsion spring 100 from.

Figure 4:
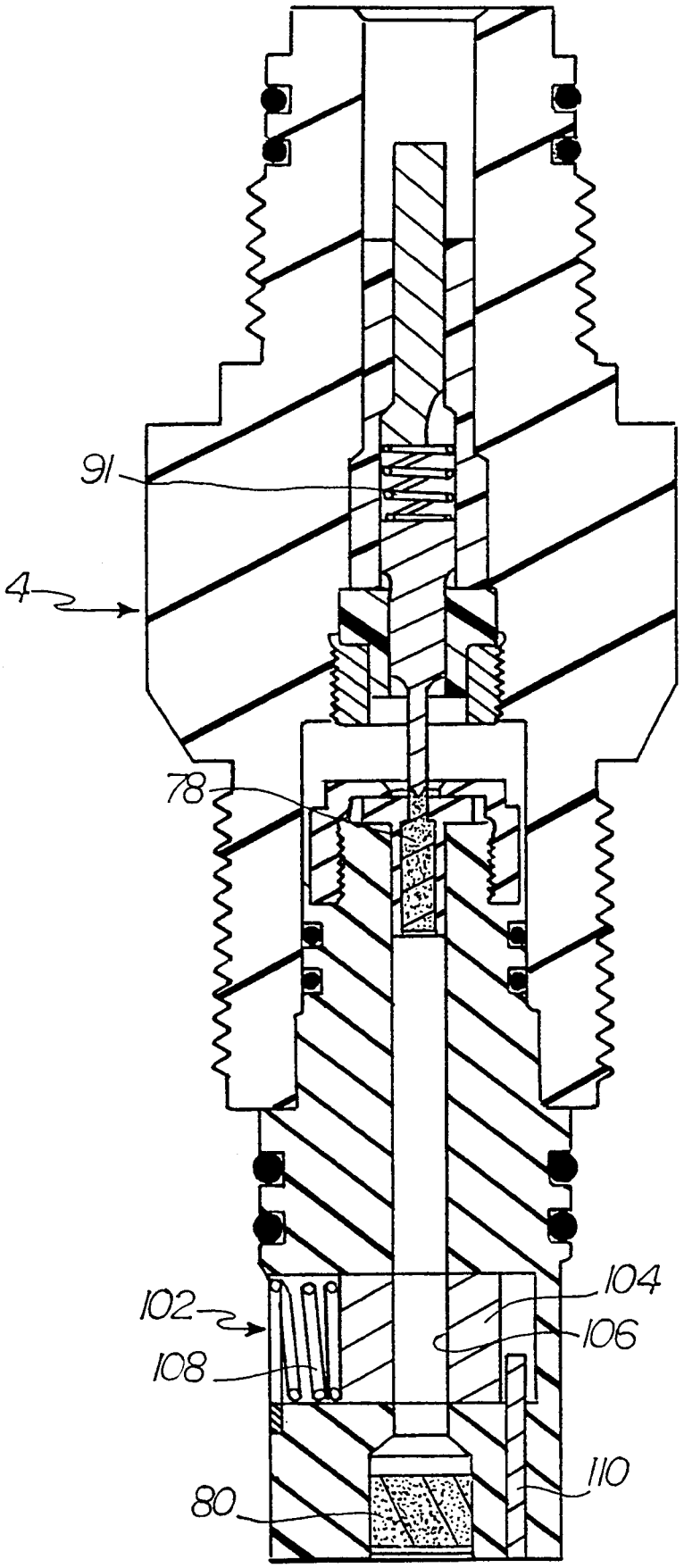
FIG. 4 is a longitudinal section view of the firing head of FIG. 3, shown after lowering downhole within a wellbore and activating the heat activated ballistic blocker of the present invention.

With reference to FIG. 4, firing head 4 is shown with valve plug 104 depicted in the ignition position, after moving from the blocking position depicted in FIG. 3. Referring now to FIGS. 3 and 4, rotation stop pin 110 is provided for preventing further rotation of valve plug 104 once valve plug 104 is moved to the ignition position from the blocking position. Rotation stop shoulder 112 (not visible in FIG. 4) of valve plug 104 is provided for engaging rotation stop pin 110 when valve plug 104 is in the blocking position. Rotation stop pin 110 is held within igniter housing 76 by a press fit within a drill hole passing longitudinally into the lower face of igniter housing 76.

It should be noted, however, that although heat activated ballistic blocker 102 is disposed between primary igniter 78 and secondary igniter 80 in the preferred embodiment of the present invention, in other embodiments of the present invention, heat activated ballistic blocker 102 may be disposed in alternative positions, such as, for example, between secondary igniter 80 and power charge 70 to prevent secondary igniter 80 from igniting power charge 70 until after downhole well tool 2 is lowered to a downhole position within a wellbore having well temperatures that are higher than the activation temperature for ballistic blocker 102.

Operation of downhole well tool 102 is now discussed with reference to the FIGS., beginning now with reference to FIG. 3. Upon lowering downhole within the wellbore, downhole well tool 2 is exposed to temperatures within the surrounding wellbore which raise the temperature of torsion member 108 to an activation temperature, which in the preferred embodiment of the present invention is substantially equal to or above 120° Fahrenheit. Once torsion member 108 reaches the activation temperature, it undergoes a thermoelastic martensitic reversion in which it changes shape and rotates valve plug 104 from the blocking position of FIG. 3, to the ignition position shown in FIG. 4, in which passageway 106 is aligned with bore 100. Primary igniter 78 can now be ignited for igniting power charge 70 and setting packer P once downhole well tool 2 is lowered to a selected position within wellbore B.

Referring to FIG. 1, electrical power is then selectively applied from electrical power supply E, through wireline W, and to wireline tool string T. Electrical power then passes from wireline tool string T, through, referring back to FIG. 3, power conductor 72 and electrical connector assembly 91, and to primary igniter 78. The electrical circuit is completed by primary igniter 78 contacting connector housing 74. Still referring to FIG. 3, connector housing 74 and igniter housing 76 provide an electrical ground for completing an electrical circuit between power conductor 72 and primary igniter 78 and power supply E (shown in FIG. 1).

With reference to FIGS. 1 and 4, power charge 70 is ignited by passing electrical current from an electrical power supply, such power supply E, and through a wireline W to a wireline tool string T, through electrical connector assembly 91, and to primary igniter 78. Primary igniter 78 includes a gunpowder load which is ignited by the electrical current conducted through electrical connector assembly 91. Primary igniter 78 burns to generate thermal energy which passes through bore 100 and passageway 106, which together provide an ignition pathway for the thermal energy to pass through between primary igniter 78 and to secondary igniter 80, for igniting secondary igniter 80. Referring to FIG. 2, secondary igniter 80 is ignited and generates heat which then ignites chemical components 71 within power charge 70. Power charge 70 then burns in a self-sustained combustion reaction to generate a gas, having a pressure which pushes floating piston 18 downward.

In the preferred embodiment of the present invention, power charge 70 will burn in a self-sustained chemical reaction, which, in the preferred embodiment of the present invention, is a combustion reaction for generating the gas. The combustion reaction of the preferred embodiment is a slow combustion reaction, burning at a rate so that a maximum level of gas pressure within pressure chamber 8 will not be reached before a one second period of time has elapsed. This is to be distinguished from explosive reactions in which explosive material is either detonated, deflagrated, or generally burns with a rate of reaction which takes no more than a time period of several milliseconds to burn the explosive materials.

Referring to FIGS. 1 and 2, movement of floating piston 18 downward pushes hydraulic fluid 66 through orifice 28 and flow port 26 to push secondary piston 34 downward. Secondary piston 34 is connected to piston rod 38, cross link 56, and sleeve 58. Movement of secondary piston 34 downward within lower cylinder 30 moves sleeve 58 downward with respect to mandrel 48. Relative movement of sleeve 58 with respect to mandrel 48 is applied to a downhole tool, such as packer P, for applying a force over a distance to set packer P within casing C. (Packer P not shown in a set position.)

If downhole well tool 2 is not operated after lowering into a wellbore to a depth sufficient to raise the temperature of torsion member 108 to substantially the activation temperature, torsion member 108 will reset heat activated ballistic blocker 102 for obstructing bore 100 during removal from the wellbore. Torsion member 108 will rotate valve plug 104 back to the blocking position upon cooling to temperatures below the activation temperature during removal from the wellbore.

The preferred embodiment of the present invention offers several advantages over prior art setting tools. One advantage is that the primary igniter cannot ignite the secondary igniter, or the power charge, until after the tool string is lowered downhole within the wellbore to sufficient wellbore depths having high enough temperatures to heat the torsion member to the activation temperature, at which the torsion member rotates the valve plug to the ignition position to provide an ignition pathway therethrough.

Further, the preferred embodiment of the present invention provides a downhole well tool for automatically providing an ignition pathway between the primary igniter and the secondary igniter only after the downhole well tool is lowered downhole within the wellbore.

Additionally, the preferred embodiment of the present invention provides a low cost method and apparatus for preventing actuation of a downhole well tool prior to running the downhole well tool to a position downhole within a wellbore.

Although the downhole well tool of the present invention has been described herein as including a wireline conveyed pressure setting assembly, other embodiments of the present invention may include other types of wellbore pressure setting assemblies, such as, for example, a tubing convened pressure setting assembly, and thus is not limited to either wireline conveyed pressure setting assemblies, or tubing conveyed pressure setting assemblies. Additionally, alternative embodiments of the downhole well tool of the present invention may include perforating guns, such as those for conveying and actuating explosive shaped charges, in addition to tubing cutters, back-off tools and other types of explosive and pyrotechnic devices. Further, the downhole well tool of the present invention is not limited to use with either pyrotechnic, or explosive actuators. While the invention has been shown in only one of its forms, it is thus not limited but is susceptible to various changes and modifications without departing from the spirit thereof.

What is claimed is:

1. An apparatus for use in a wellbore to prevent an igniter from igniting a pyrotechnic device within a downhole well tool until after said downhole well tool is disposed downhole within said wellbore, said apparatus comprising:

a housing having an ignition pathway extending therein, through which said igniter reacts for igniting said pyrotechnic device;

a solid blocking member which is movable between a plurality of positions for selectably obstructing said ignition pathway to prevent said igniter from igniting said pyrotechnic device; and an actuator for lowering downhole within said wellbore with said downhole well tool and heating to an activation temperature, at which said actuator moves said solid blocking member from a blocking position obstructing said ignition pathway to an ignition position for allowing said igniter to ignite said pyrotechnic device.

2. The apparatus of claim 1, wherein said igniter is a primary igniter which is included within said housing, and said apparatus further comprises:

a secondary igniter disposed within said housing for igniting said pyrotechnic device in response to being ignited by said primary igniter; and said solid blocking member, when in said blocking position is disposed between said primary and secondary igniters for preventing said primary igniter from igniting said secondary igniter, and thus preventing said primary igniter from igniting said pyrotechnic device.

3. The apparatus of claim 1, wherein at least a portion of said solid blocking member is moved laterally aside of said ignition pathway when moved from said blocking position to said ignition position.

4. The apparatus of claim 1, wherein at least a portion of said solid blocking member is moved laterally across said ignition pathway and into said blocking position during removal of said downhole well tool from said wellbore, at least when said igniter has not been ignited.

5. The apparatus of claim 1, wherein said actuator is heated to said activation temperature by exposure to downhole wellbore temperatures.

6. The apparatus of claim 1, further comprising:

a wellbore pressure setting assembly; and a settable downhole well tool for lowering within said wellbore, and urging into a setting engagement within said wellbore.

7. An apparatus for use in a wellbore to prevent an igniter from igniting a pyrotechnic device within a downhole well tool until after said downhole well tool is disposed downhole within said wellbore, said apparatus comprising:

a housing having an ignition pathway extending therein, through which said igniter reacts for igniting said pyrotechnic device;

a blocking member which is movable between a plurality of positions for selectably obstructing said ignition pathway to prevent said igniter from igniting said pyrotechnic device; and an actuator for lowering downhole within said wellbore with said downhole well tool and heating to an activation temperature, at which said actuator rotates said blocking member from a blocking position obstructing said ignition pathway to an ignition position for allowing said igniter to ignite said pyrotechnic device.

8. The apparatus of claim 7, wherein said actuator is heated to said activation temperature by exposure to downhole wellbore temperatures.

9. The apparatus of claim 7, wherein said actuator is formed from a shape memory metal.

10. The apparatus of claim 7, wherein said actuator positions said blocking member into said blocking position during removal of said downhole well tool from said wellbore, at least when said igniter has not been ignited.

11. The apparatus of claim 7, wherein said igniter is retained within said housing for lowering within said wellbore.

12. The apparatus of claim 11, further comprising: explosive materials.

13. The apparatus of claim 11, further comprising:

a perforating gun having a plurality of shaped charges.

14. The apparatus of claim 11, further comprising:

an explosive device for severing wellbore tubular members.

15. The apparatus of claim 11, further comprising:

a wellbore pressure setting assembly; and a settable downhole well tool for lowering within said wellbore, and urging into a setting engagement within said wellbore.

16. An apparatus for use in a wellbore to prevent an igniter from igniting a power charge within a wellbore pressure setting assembly until after said wellbore pressure setting assembly is disposed downhole within said wellbore, said apparatus comprising:

a tubular housing having a passageway extending longitudinally therein, said passageway providing an ignition pathway through which said igniter reacts for igniting said power charge within said wellbore pressure setting assembly.

a blocking member which is movable between a plurality of positions for selectably obstructing said passageway to block said ignition pathway and prevent said igniter from igniting said power charge; and an actuator for lowering downhole within said wellbore with said wellbore pressure setting assembly and heating to an activation temperature, at which said actuator moves said blocking member from a blocking position obstructing said passageway to an ignition position for allowing said igniter to ignite said power charge.

17. The apparatus of claim 16, wherein said actuator moves said blocking member to said ignition position by rotating said blocking member.

18. The apparatus of claim 16, wherein said igniter is retained within said housing for lowering within said wellbore.

19. The apparatus of claim 18, further comprising:

said wellbore pressure setting assembly; and a settable downhole well tool for lowering within said wellbore, and urging into a setting engagement within said wellbore.

20. An apparatus for use in a wellbore to prevent an igniter from igniting a power charge within a wireline pressure setting assembly until after said wireline pressure setting assembly is disposed downhole within said wellbore, said apparatus comprising:

a tubular housing having a passageway extending longitudinally therein, said passageway providing an ignition pathway through which said igniter reacts for igniting said power charge within said wireline pressure setting assembly, a valve plug which is movable for rotating between a plurality of positions for selectably obstructing said passageway to block said ignition pathway and prevent said igniter from igniting said power charge; and a torsion member formed from a shape memory metal for lowering downhole within said wellbore with said wireline pressure setting assembly and exposing to downhole wellbore temperatures, which heat said torsion member to an activation temperature at which said torsion member rotates said valve plug from a blocking position obstructing said passageway to an ignition position for allowing said igniter to ignite said power charge.

21. The apparatus of claim 20, wherein said torsion member positions said valve plug into said blocking position during removal of said wireline pressure setting assembly from said wellbore, at least when said igniter has not been ignited.

22. The apparatus of claim 20, further comprising:

said wireline pressure setting assembly; and a settable downhole well tool for lowering within said wellbore, and urging into a setting engagement within said wellbore.

23. A method for preventing an igniter from igniting a pyrotechnic device within a downhole well tool until after said downhole well tool is disposed downhole within a wellbore, said method comprising the steps of:

securing a housing to a downhole well tool so that a passageway extending longitudinally within said tubular housing extends between said igniter and said pyrotechnic device;

obstructing said passageway with a blocking member for preventing said igniter from igniting said pyrotechnic device;

providing an actuator which is operable for moving said blocking member between a plurality of positions;

lowering said wellbore pressure setting assembly and said housing downhole within said wellbore; and heating said actuator to substantially an activation temperature, at which said actuator moves said blocking member from a position obstructing said passageway to a position for allowing said igniter to ignite said pyrotechnic device.

24. The method of claim 23, wherein said actuator is heated to said activation temperature by exposure to downhole wellbore temperatures.

25. The method of claim 23, further comprising the step of:

forming said actuator from a shape memory metal.

26. The method of claim 23, wherein said actuator positions said blocking member into said position obstructing said passageway during removal of said wellbore pressure setting assembly from said wellbore, at least when said igniter has not been ignited.

27. A method for preventing an igniter from igniting a pyrotechnic device within a downhole well tool until after said downhole well tool is disposed downhole within a wellbore, said method comprising the steps of:

securing a housing to a downhole well tool so that a passageway extending longitudinally within said tubular housing extends between said igniter and said pyrotechnic device;

obstructing said passageway with a blocking member for preventing said igniter from igniting said pyrotechnic device;

providing an actuator which is operable for moving said blocking member between a plurality of positions;

lowering said wellbore pressure setting assembly and said housing downhole within said wellbore; and exposing said actuator to downhole wellbore temperatures, which heat said actuator to substantially an activation temperature, at which said actuator rotates said blocking member from a position obstructing said passageway to a position for allowing said igniter to ignite said pyrotechnic device.

28. The method of claim 27, wherein said actuator positions said blocking member into said position obstructing said passageway to prevent said igniter from igniting said power charge during removal of said wellbore pressure setting assembly from said wellbore, at least when said igniter has not been ignited.

29. A method for preventing an igniter from igniting a power charge within a wellbore pressure setting assembly until after said wellbore pressure setting assembly is disposed downhole within a wellbore, said method comprising the steps of:

securing a tubular housing to a wellbore pressure setting assembly so that a passageway extending longitudinally within said tubular housing extends between said igniter and said power charge;

obstructing said passageway with a blocking member for preventing said igniter from igniting said power charge;

providing an actuator which is operable for moving said blocking member between a plurality of positions;

lowering said wellbore pressure setting assembly and said housing downhole within said wellbore; and heating said actuator to substantially an activation temperature, at which said actuator operates to move said blocking member from a position obstructing said passageway to a position for allowing said igniter to ignite said power charge.

30. The method of claim 29, wherein said actuator moves said blocking member to said position for allowing said igniter to ignite said power charge by rotating said blocking member.

31. The method of claim 29, wherein said actuator is heated to said activation temperature by exposure to wellbore temperatures.

32. The method of claim 29, wherein said actuator positions said blocking member into said position obstructing said passageway to prevent said igniter from igniting said power charge during removal of said wellbore pressure setting assembly from said wellbore, at least when said igniter has not been ignited.

* * * * *